United States Patent [19]

Pittman

[11] Patent Number: 5,052,964

[45] Date of Patent: Oct. 1, 1991

[54] ANTI-ROLL WATER SKI TOW LINE

[76] Inventor: Alan K. Pittman, 6644 Smoketree Ave., Agoura, Calif. 91301

[21] Appl. No.: 441,909

[22] Filed: Nov. 28, 1989

[51] Int. Cl.[5] ..... A63C 11/10

[52] U.S. Cl. ..... 441/69

[58] Field of Search ..... 441/69

[56] References Cited

U.S. PATENT DOCUMENTS

| | | | |
|---|---|---|---|
| 4,043,290 | 8/1977 | Holland | 441/69 |
| 4,540,371 | 9/1985 | Taylor | 441/69 |
| 4,863,407 | 9/1989 | Casad | 441/69 |

*Primary Examiner*—Sherman Basinger
*Assistant Examiner*—Thomas J. Branan
*Attorney, Agent, or Firm*—David O'Reilly

[57] ABSTRACT

A water ski tow line constructed to provide anti-rotation of the tow line handle. The water ski tow line has a handle with holes at each end traversing the handle. A tow line is attached to each end of the handle by passing the line around the handle and through the holes traversing the handle such that two lines are provided extending from tangent points on opposite sides of the handle. These two lines effectively provide opposing torques on either side of the handle, preventing rotation of the handle during use. The skier's hands are protected by end caps formed of a cup fitting over the end of the handle covering the rope, having a sheath extending away from the handle and covering the loop formed by the two lines. The two lines are then joined at a yoke forming a single tow line. A yoke protector is produced by a unique tool to cover and protect the yoke area of the water ski tow line.

9 Claims, 4 Drawing Sheets

3
32
12
22
24
25
30
26
B
A
14
66
64
52
28
34
64'
66'
36
16
3

4
12
60
57
54
70
56
71
26
25
14
68
66'
62
58
36
16
4

54
70
12
25
24
22
68
64'
14
16

50
48
12
22
24
26
44
42
40
38
52

ANTI-ROLL WATER SKI TOW LINE

FIELD OF THE INVENTION

This invention relates to water ski tow lines, and more particularly, relates to a water ski tow line that substantially eliminates the phenomenon of roll-out.

BACKGROUND OF THE INVENTION

Conventional water ski tow lines are comprised of a single line forming a pair of strands at a yoke which are attached to the handle by passing straight through apertures in the handle, wrapping around and returning through the same hole. The force on the tow line handle is thus in a plane parallel with the handle axis and the axis of extension of the tow line. This particular arrangement has been found to cause a problem of the handle being twisted out of one's grip which can be appropriately referred to as "roll-out". This is caused particularly when the ski tow line is being used in competition such as the slalom, where the line shortened after each run by the competitors through the slalom.

Historically, water ski tow line handles are attached to the tow line at two points, one at each end of the handle. There are several methods utilized to attach the line to the handle ends. In some cases, the line passes through a hole in the handle and is tied in a knot. In another method, the line passes through the hole in the handle, wraps back around the handle and rejoins the main line. The latter is tied to the handle with a single or double entry through the hole in the ends of the handle. Sometimes a hollow tubular handle is used and the line passes through an aperture in the surface of the handle and is tied in a knot inside the hollow handle. While all of these methods are effective for tying a ski tow line to a handle, they are subject to the problem of the handle rotation in use. Except for the stiffness of the line and protective sheaths at the ends of the handle (which is generally negligible) the handle is free to pivot about the point where the line exits from the handle. When a water skier has a very firm grip, the handle can rotate from a position normal to the axis of line extension.

The problem is that as the skier's grip becomes tired of the force of the pull and when the force nears the skier's grip limit, the handle can begin to slip out of the hand. When this occurs, the thumb is first to let go, and the grip is then maintained by virtue of the semi-circular arc formed by the fingers. Loss of the ski line is not hopeless at this time, that is, it's quite common for a skier to experience a momentary surge followed by slack, during which he can recover the grip on the ski tow line handle. However, during the period of partial grasp of just the fingers, most of the grip will result in friction between the hand and the handle, from the tip of the fingers up to where they join the palm of the hand. The resultant force can act as a twisting or rotational force on the handle which can have the effect of "unwinding" the hand from the handle which further can reduce the skier's grip. This action is aptly called "roll-out".

Another disadvantage of this particular method of tying the tow line is that the line passes around the handle ends and is often exposed. This exposed portion of the line can chafe the hands, and can become worn from abrasion. End caps have been designed to eliminate this problem by completely covering the ends of the handle and exposed line. End caps for this purpose are disclosed and described in U.S. Pat. No. 4,335,478 issued June 22, 1982 to the same inventor as the device disclosed herein.

A further problem is the wear on tow lines at the yoke, where the two woven strands of line from the handle come together to form the single line. This is another problem area where the line can become worn or chafed, causing a defective tow line. It would be advantageous if a heavy protective covering could be easily installed at the tow line yoke.

It is, therefore, one object of the present invention to provide a water ski two line that substantially prevents roll-out. Yet another object of the present invention is to provide a water ski tow line in which the line is tied to the handle in a manner which will provide an anti-roll action to eliminate roll-out.

Yet another object of the present invention is to provide a water ski tow line handle in which the line can be tied to provide equal and opposite forces at tangent points on opposite sides of the handle to minimize or eliminate roll-out.

Still another object of the present invention is to provide water ski tow line end caps which permit a tow line to be tied in a manner that minimizes or prevents roll-out.

Still another object of the present invention is to provide water ski end caps that will provide a protective cover for the ends of the handle and the loop formed by tying the line to the handle to prevent roll-out.

Still another object of the present invention is to provide a method of making a protective covering for a water ski tow line yoke that can be easily made in a single operation.

Yet another object of the present invention is to provide a protective covering for a water ski tow line yoke that can be quickly and easily installed.

Still another object of the present invention is to provide a protective covering for a water ski tow line yoke that has a webbed portion that can be used for decorative purposes.

BRIEF DESCRIPTION OF THE INVENTION

The purpose of the present invention is to provide an improved water ski tow line anti-roll handle having protective end caps and a unique protective covering for the tow line yoke.

The phenomenon of "roll-out" can be substantially eliminated by attaching the tow line to each end of the handle to provide anti-rotation at four points (two points at each end). The rope is tied to provide tangent force points on opposite sides of the handle, and extends away from the handle and spliced. If the splice point is sufficiently far away from the points where the rope is attached on opposite sides of the cylindrical handle, any tendency to twist is prevented by a direct restraining action or torque at the attachment points. That is, there are equal and opposite torques applied to the opposite points on the circumference of the handle. Thus there is no "pivot" points as there are in all previous methods of attaching a tow line to a ski tow rope handle.

A practical implementation of the new technique utilizes standard hollow braid ski rope and a handle having a hole through each end. In one embodiment, the hole traverses the handle oriented perpendicular to the axis of extension or plane through the axis of the handle and length of ski tow line. In this embodiment, the line is passed through the traverse hole around the back of the handle and then returns through the traverse hole. This method of tying the rope to the handle positively locks the handle to the rope to prevent slipage between the rope and handle. The transverse hole also acts to prevent the rope from slipping off the end of the handle. After the rope exits the transverse hole in the handle, it is joined at a splice which is sufficiently far away from the handle to provide the anti-twist torque effect desired.

In another embodiment, the hole is positioned horizontally in the same plane as the axis of the handle and the extension of the rope. In this embodiment, the rope loops around the handle with each end passed through the horizontal hole, around the handle and through itself to be joined in a splice sufficiently far away from the handle so as to provide the anti-twist torque effect desired. The latter method of tying the rope is preferred because there is no torque or force on the rope at an edge as there would be with a traverse hole where the rope exits the hole on each side of the handle.

End caps for this rope provide an open area through which the two strands or lengths of rope providing the anti-twist effect may pass. The end caps cover the area of the rope extending from the handle to the splice because the potential exists of a finger or hand of a skier possibly being caught in the loop formed between the handle and the splice. The end cap design described can be used to completely enclose this loop. An end cap design in the form of a "wedge" would work reasonably well. To completely cover the loop, the end caps are made with channels that route the rope around the handle and through the hole in the handle with a web between the channels to close any openings where a finger or hand might be caught. With the method described, the water ski tow rope can be constructed with a rope tied to provide the anti-roll torque effect and covered with end caps which completely enclose the loop from the handle to the splice with a web in the end cap, preventing any openings in the loop from being exposed.

In another embodiment, the end cap is formed with a sleeve having parallel channels extending from a cup that fits over the handle. A closing web joins the adjacent channels. In this embodiment, the end cap covers the anti-roll strands of the line a few inches from the handle to just before the splice of the strands into a single line.

In another embodiment of the invention, the handle is formed of a rigid tube covered with a thick layer of resilient material which also forms integral sleeves for covering a portion of the line a few inches from the handle. The sleeves are formed during the process of covering the handle with the thick coating of resilient material. The rigid tubular member beneath the thick coating of resilient material has holes perpendicular to the axis of the sleeves for receiving the water ski tow line. As described above, the line at each end of the handle passes through the hole in the end of the handle around the rear of the handle and back through the hole in the opposite direction to be again joined at a splice a few inches from the handle's end. A groove is formed in the thick, resilient coating where the line loops around or encircles the rear portion of the handle for receiving the portion of the line that extends outside the handle. The two strands of the line forming the anti-roll arrangement extend down bores in the sleeve formed on the handle and are spliced near the end of the sleeve. The spliced line then is joined at a Y shaped yoke with the line from the other end of the handle to form a continuous line.

Water ski tow ropes are subject to high stress and chafing during normal use, and the point where the rope joins the long line or the yoke is a particular area of wear. Therefore, a cover over this particular area would protect the yoke and result in a longer lasting ski line for the consumer. Covers for the yoke have been designed to give the lines a very different look and are made by a particularly unique technique. The covers are dip molded with the legs of the Y formed as ridges on rolled edges of a flat plate, terminating in a cylindrical tail. When dipped in a plastic or plastisol material, a part is formed having a tubular tail, two tubular arms each joined on either side by webs with an opening in between. The webs can be sealed and cut off with a dye cutter or the legs of the Y can be sealed with the webs forming a decorative flat surface.

The Y-shaped article is formed by a unique technique. The unique technique uses a tool to dip mold the Y-shaped piece having round ridges along the edges forming the legs of the Y, terminating in a cylindrical tail. The flat portion of the plate between the legs of the Y forms webs on either side of the molded article. After removal, the opening between the webs can be bonded or sealed at the legs of the Y and then removed or used for a decorative logo. The method can be an effective way to form any Y-shaped tubular part.

The above and other novel features of the invention will be more fully understood from the following detailed description and the accompanying drawings in which:

DETAILED DESCRIPTION OF THE INVENTION

Figure 1:
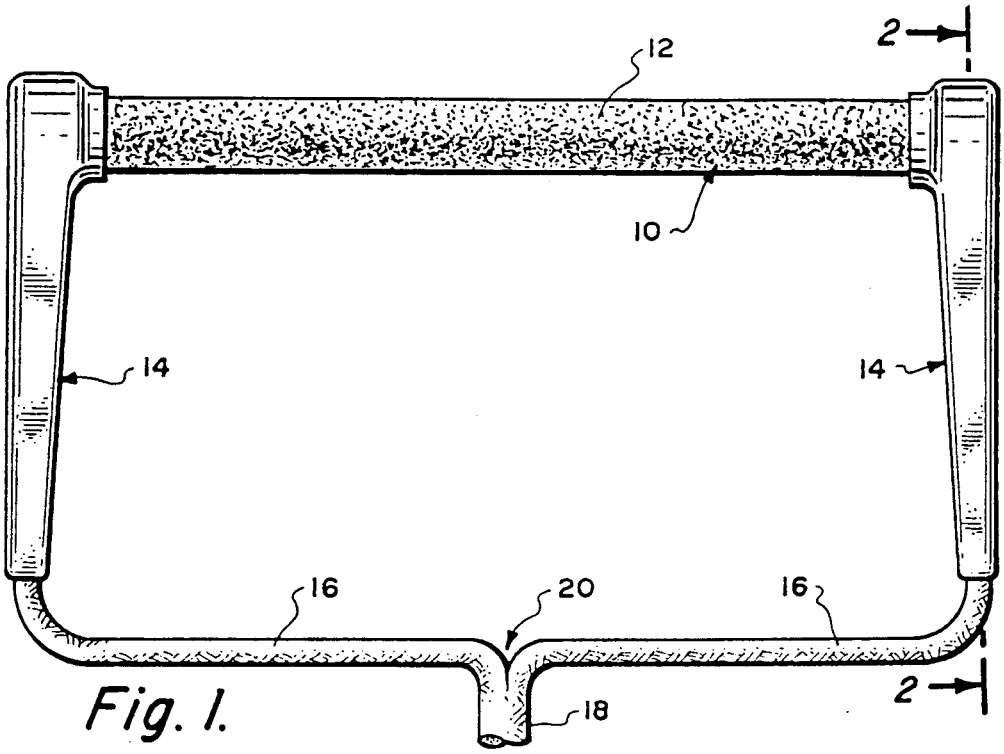
FIG. 1 is a plan view of a water ski tow line handle constructed according to the invention.

A water ski tow line handle constructed according to the invention is illustrated in FIG. 1 at 10 and having a hand grip 12 coated with a resilient rubber or plastic material. Each end of the hand grip 12 is covered with end caps 14, covering the line for a few inches with a sleeve that extends away from the hand grip. The line 16 is spliced together at 18, forming a yoke 20. This particular area of water ski tow lines is subject to chafing and wear and needs protection by a device which will be described in greater detail hereinafter.

As was described previously, historically the line 16 is tied to the hand grip 12 so that the line exits the center of the handle and extends to the splice 18. However, this method of attaching the line can provide a pivot point, allowing the hand grip 12 to rotate, resulting in the phenomenon called "roll-out," where a torque created by rotating the hand grip can tear or loosen a grip on the tow line.

Figures 2, 2A, 3, 4:
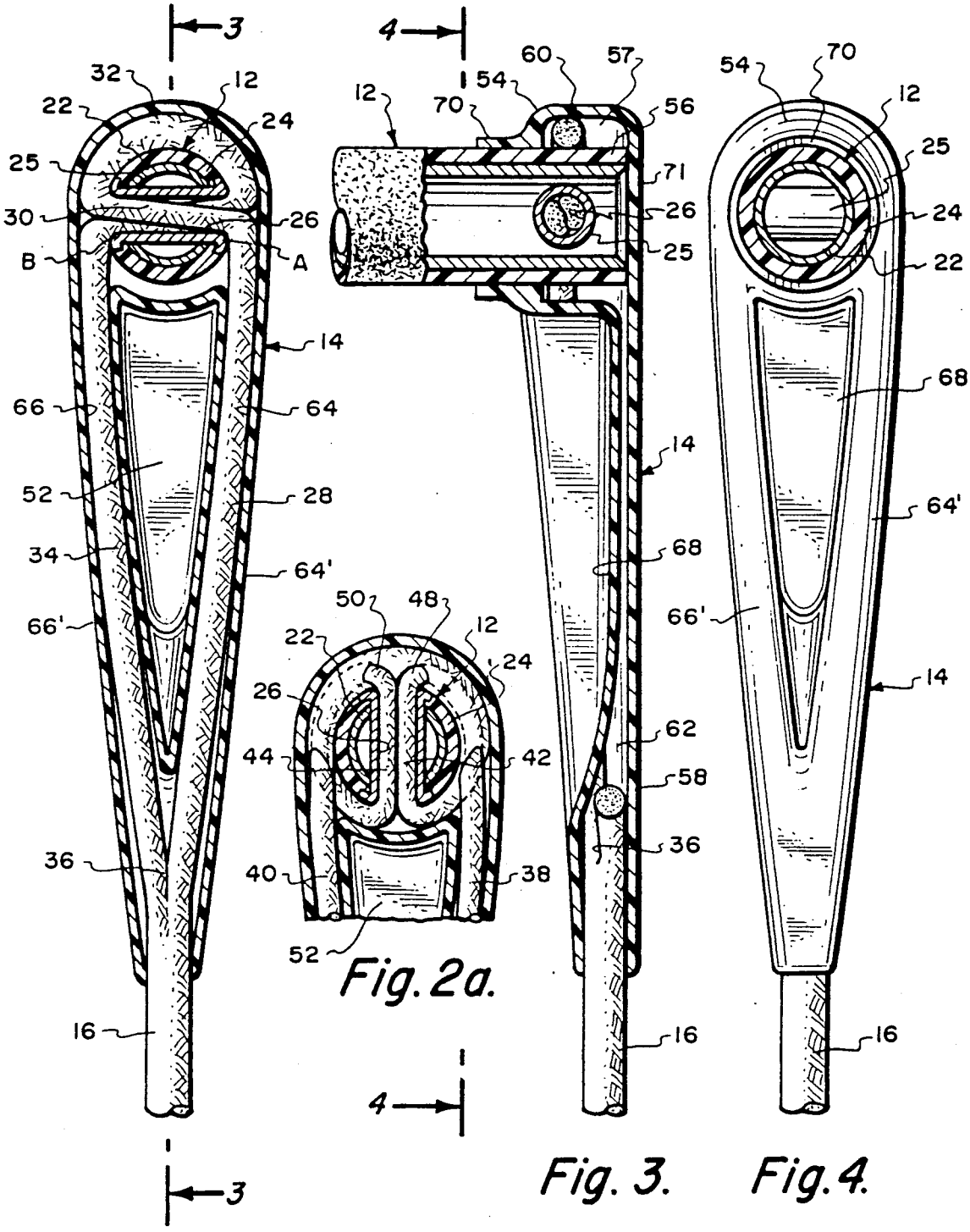
FIG. 2 is a sectional view of the water ski tow line handle taken at 2—2 of FIG. 1.
FIG. 2*a* illustrates an alternate method of providing an anti-roll attachment on the tow line to the water ski tow line of FIG. 1.
FIG. 3 is a sectional view taken at 3—3 of FIG. 2.
FIG. 4 is a sectional view taken at 4—4 of FIG. 3.

To prevent this effect, a unique method of attaching the line to the hand grip 12 is to provide equal and opposite forces at tangent points on either side of the hand grip. This method of attaching the line effectively prevents the handle grip 12 from being rotated. Such a method of attaching the line is illustrated in FIGS. 2–4. In the sectional view of FIG. 2, taken at 2—2 of FIG. 1, end cap 14 covers the end of tubular hand grip 12, usually formed of a metal or hard hollow tube 22, coated with a heavy coating of resilient rubber or plastic material 24. The tubular hand grip 12 is provided with an aperture or hole 26 through each end formed by small tube 25 for attachment of line 16. In the first method, the line 16 is attached through hole 26 traverses the handle perpendicular to a plane through the axis of the handle and the line.

First, a portion of the line at 28 passes through the traverse hole 26 in the handle at 30, wraps around the back of the hand grip 12 at 32, and then passes back through the traverse hole 26, ending in line portion 34. The line is then spliced at 36, forming single line 16.

This method of tying the line provides torque at points labelled A and B, which are equal and opposite to resist rotation of hand grip 12. This method of tying the line to the handle effectively prevents rotation of the handle, and thus prevents roll-out.

An optional but preferred method of tying the line to the handle is illustrated in FIG. 2*a*. This hand grip 12 has the same tube 22, resilient covering 24 and hole through each end of the handle 26 as before. However, in this embodiment, the hole in the handle 26 is oriented parallel to the plane through the axis in the handle and the tow line 16. That is, in use, the hole 26 will be parallel to the direction of extension of tow line 16. The tow line is tied to the hand grip 12 by passing the ends 38 and 40 through hole 26 as shown at 42 and 44. The ends then exit hole 26 at 48, 50 and pierce the loop of the line around the back of the handle. The line is then threaded through itself and spliced at a distance from the handle as before (FIG. 2, splice 36). The line is preferably a hollow braid rope that forms a hollow cylinder when compressed axially allowing the line to be easily threaded through itself. This method of tying the line is preferred, because the forces are provided at tangent points on opposite sides of hand grip 12, which extend around curve surfaces, distributing the forces evenly, rather than at the edges of the holes as in the previous embodiment. While only two ways of tying the line are shown, of course there are many other ways the line may be tied to the handle that would produce the two lines extending from tangent points on opposite sides of the handle.

This method of tying the tow line to the handle provides an open area or loop at 52 between each line attached to the handle. This opening presents a potential hazard to a skier if a finger or hand were caught in the loop. Therefore, unique end caps 14 have been designed to cover the loop as well as to protect the ends of the handle and prevent any exposure of the line around the area of the hands. The end cap is shown in greater detail in FIGS. 3 and 4, with alternate designs illustrated in FIGS. 13 and 14. The end caps are formed in a tapered "wedge" style and work very effectively to protect the ends of the handle and the tow line where it is attached to the hand grip 12.

The end caps 14 are formed with cups 54 which fit over the end 56 of the hand grip 12 and have a recess or indentation 57 to receive the portion of the line 60, passing around the back of the handle. The cup extends to a sleeve portion 58 which is open as shown at 62. This allows the line 16 to easily pass through one channel 64 (FIG. 2), attached to hand grip 12 and then return through a channel 66 in the opposite side. In forming end caps 14, a web of material at 68 provides a closure for the loop 52 between the two line portions formed when the line is attached by either of the methods of FIGS. 1 or 2. The cup 54 shrinks to a lip 70 to tightly grip hand grip 12.

The end cap design 14 shown in FIGS. 3 and 4 extends beyond splice 36 in the line 16, completely covering the loop formed in the anti-roll connection of the line to hand grip 12. The line passes through tubular portions 64' and 66', forming channels 64 and 66. The loop is closed by web 68 formed in the end cap.

The cup portion 54 of the end caps provide a closure at 71 to close the hollow ends of the hand grip 12. This prevents debris and water from entering the handle, which could cause deterioration of the line.

Figure 13:
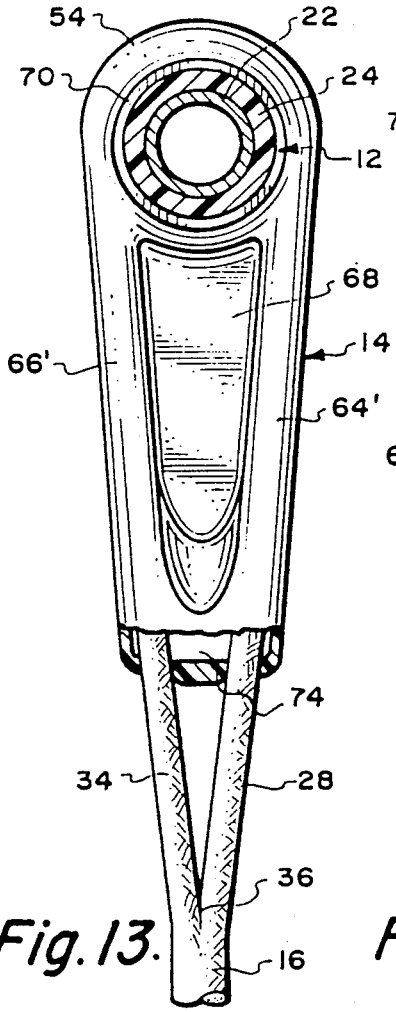
FIG. 13 is a sectional view similar to FIG. 4 partially removed to illustrate the splice of the water ski tow line at the handle.
Figure 14:
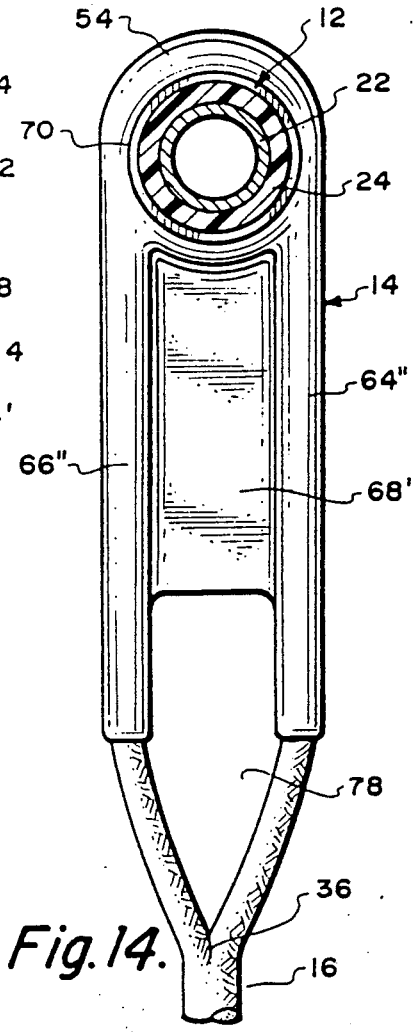
FIG. 14 is a sectional view similar to FIG. 4, illustrating an alternate embodiment of the end cap for the water ski tow line of in FIG. 1.

In the alternate embodiments of FIGS. 13 and 14, the end caps form cups 54 as before that fit over the end of hand grip 12 and as shown in FIG. 13, provide tubular portions 64' and 66', joined by a closed web 68. The end cap is open at 74 to allow the line to easily pass through and be wound or tied to the hand grip 12.

In the embodiment of FIG. 14, the cup 54 again closes the end of the tubular hand grip 12 and has the lip 70 firmly gripping resilient surface 24. In this embodiment, the tubular portion 64'' and 66'' are separated by a web 68' which maintains them substantially parallel for a distance from the handle, terminating shortly before the splice 36. This arrangement is less desired because it does provide an open loop area at 78 between the end of the end cap 14 and splice 36.

Figure 5:
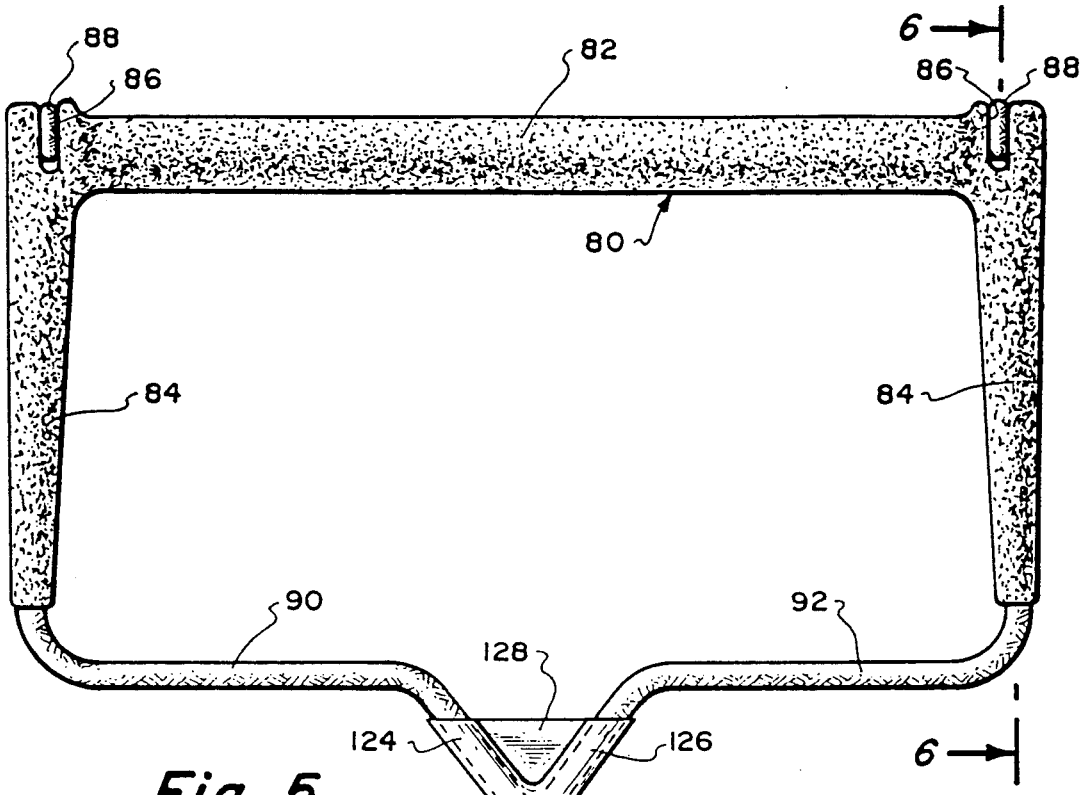
FIG. 5 is a plan view of a molded water ski tow line handle according to the invention.
Figure 9:
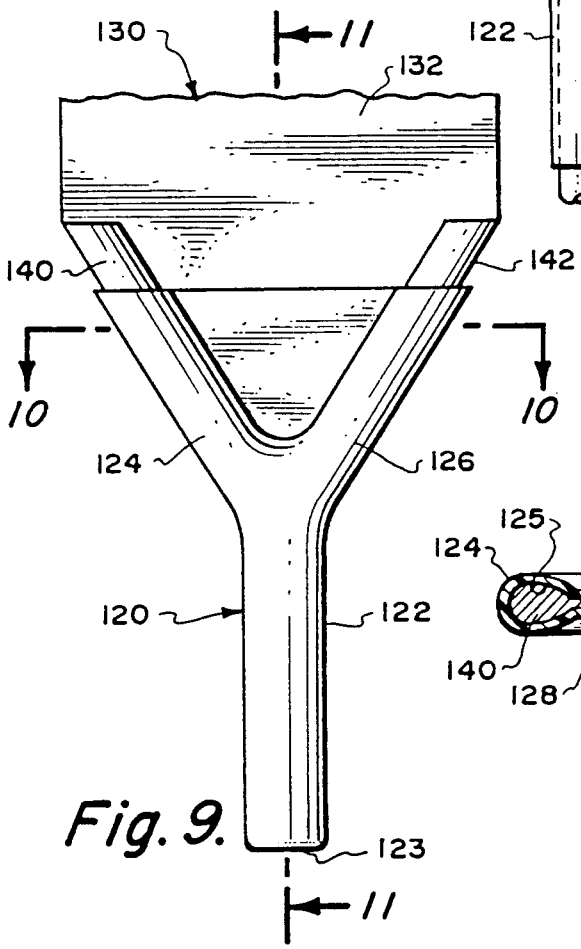
FIG. 9 is a view in partial section of a tool holder for forming a Y-shaped tubular device which may be used for a protective cover for the yolk area of water ski lines.

An alternate embodiment of the anti-roll water ski toe line is shown in FIG. 5 in which hand grip 82 and sleeves 84 at the end of handle 80 are formed in a one-piece molded design. A portion of handle 80 is open, providing a recess or groove at 86, for the portion of the exposed line 88 providing some protection. The line extends away from hand grip 82 to portions 90 and 92, spliced together at yoke 94, covered by a protective yoke cover 120, formed in a unique manner which will be described hereinafter.

The heavy resilient coating 85 on the ski tow line 80 forms sleeves 84 having channels 98 and 100, allowing line 92 to be tied to the handle as previously described. The rigid tube 85 has an aperture or hole 102 formed by tube 103 passing through each end of the handle for attachment of line 88. The line is tied as before with the portion of the line 104 passing through the hole 102 at 106 around the back of the handle in the channel 86 at 88, back through traverse hole 102 to portion 108 to be spliced at 110.

As before, sleeves 84 formed on handle 80 include a web portion 112 closing the loop between the sections of line 104 and 108. The sleeve 84 is a tapered wedge shape and extends down slightly beyond splice point 110. The splice point is positioned far enough from the hand grip 82 to allow the sections of the line 104 and 108 to provide equal and opposite torques on the hand grip 82 as before.

The one-piece molded design water ski tow line handle 80 of FIG. 5 has some advantages, but also some disadvantages. One disadvantage is that line 88 has a small area exposed at the end of the handles which can become chafed and worn. An advantage, however, is that sleeves 84 covering the end of the handles are an integral part of the handle and therefore cannot come off. In any case, the line is tied as previously described to provide a force which resists or prevents rotation of the grip, thus substantially preventing the phenomenon of roll-out.

The yoke 94 in FIG. 5 and 20 of FIG. 1 is an area where wear can be a particular problem with water ski tow line tow lines. This particular area or spot is subject to high stresses and chafing during normal use. For that reason, a unique cover was designed to protect this area. Such a yoke cover is shown at 120 of FIG. 5. The yoke cover 120 has a tubular portion 122 extending to tubular legs 124 and 126, completely covering and protecting the yoke area 94 of tow line 96. The yoke Y-shaped protector has a web 128 formed during the manufacturing process. The web 128 provides a unique area that can be used for advertising or logos.

Figure 12:
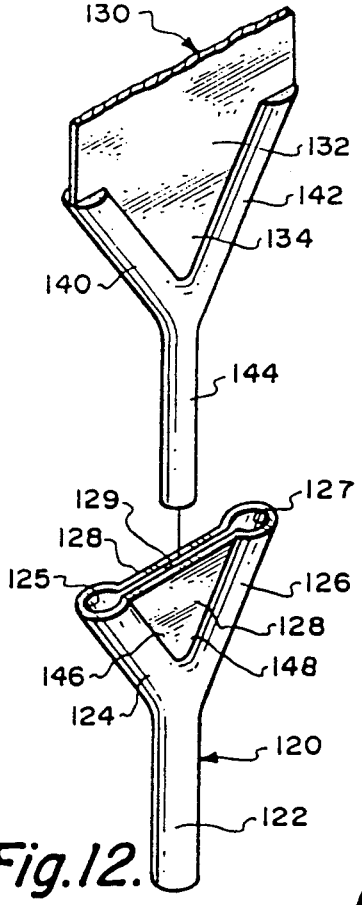
FIG. 12 is an exploded view of the Y-shaped article and the tool forming it, shown at FIG. 9.

The yoke protector 120 is formed on a tool used for dip molding shown more clearly in FIG. 12. The tool 130 has a plate 132 having a tapering portion at 134, creating edges to form the legs of the Y-shaped yoke cover 120. This area of the plate is provided with cylindrical ridges or rolled edges 140, 142 and ends in a cylindrical tail portion 144 to provide the tubular portion of yoke cover 120. The tool can be used in a dip molding process to form the tubular portion 122 and tubular legs 124 and 126 of the yoke cover 120.

Figure 10:
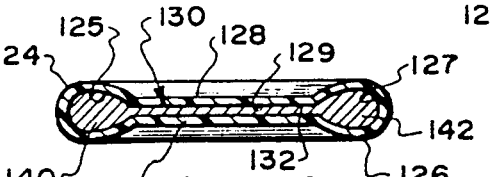
FIG. 10 is a sectional end view of a Y-shaped tubular article and the tool holder taken at 10—10 of FIG. 9.
Figure 11:
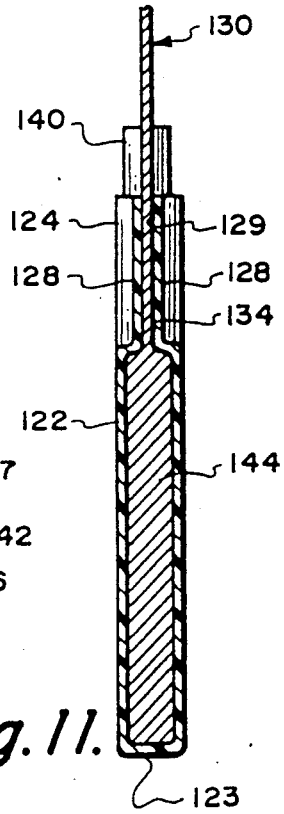
FIG. 11 is a sectional side elevation of Y-shaped yoke cover and a tool taken at 11—11 of FIG. 9.
Figure 6:
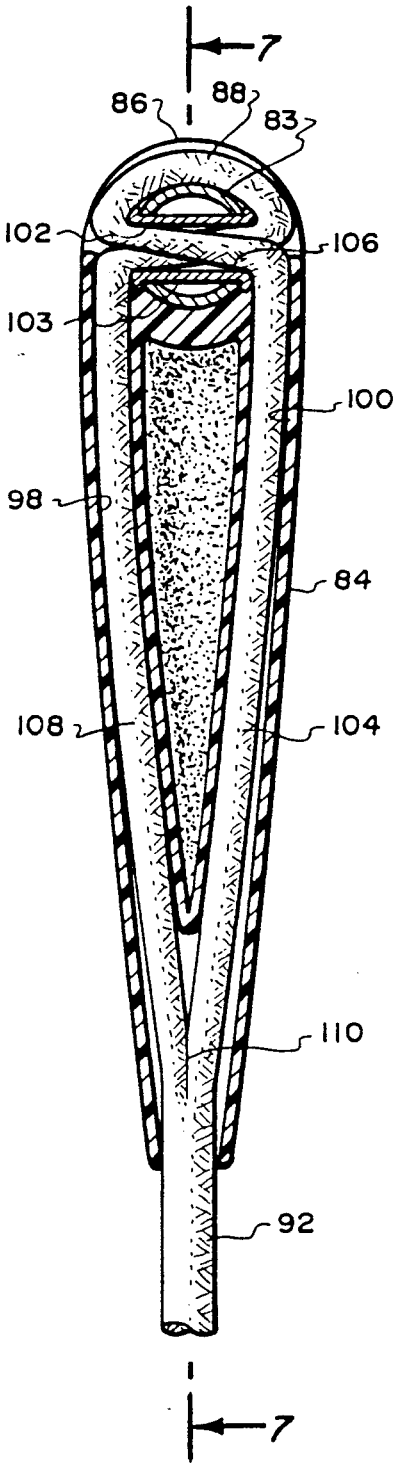
FIG. 6 is a sectional view taken at 6—6 of FIG. 5.
Figure 7:
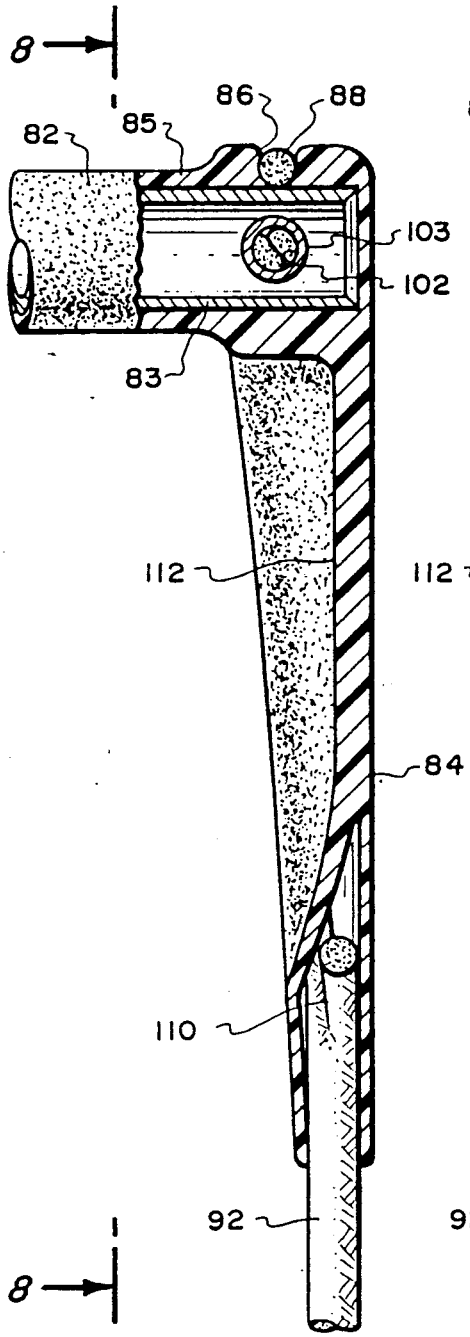
FIG. 7 is a sectional view taken at 7—7 of FIG. 6.
Figure 8:
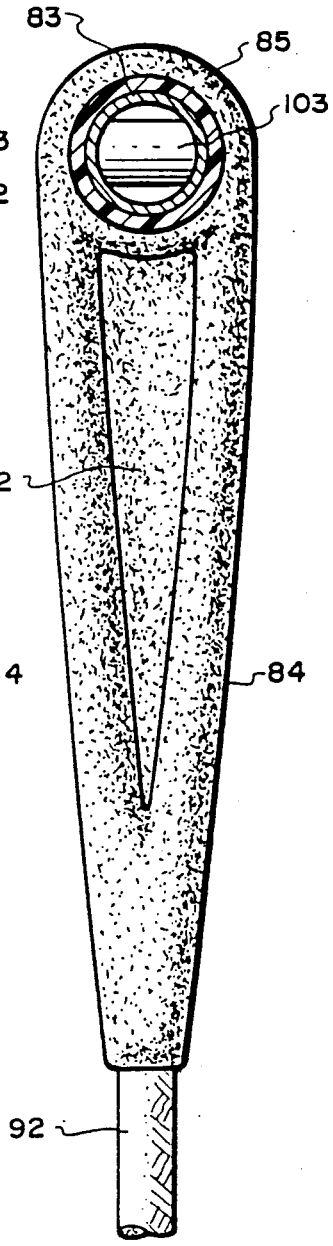
FIG. 8 is a view taken at 8—8 of FIG. 7.

As can be seen in the sectional views of FIG. 10 and 11, when legs 124 and 126 are formed, webs 128 are formed on either side of the tool 130. The cylindrical tail portion 144 of the tool forms tube 122 which will be closed at end 123. This closed end can be punched out after removal from the article as shown in FIG. 12.

This unique method can be used for forming any Y-shaped tubular article, such as a stethoscope or some other tubular article in which the Y or yoke shape is required. The use of the tool for producing the yoke cover 120 is particularly appropriate, but is also applicable to a variety of other articles. The yoke cover 120 is formed by dipping the tool 130 in a suitable resilient material such as plastisol. The tool is then withdrawn and the piece removed by any suitable means such as compressed air. The piece formed is shown in FIG. 12, having the tubular portion 122 with a closed end 123 (FIG. 11) which can be easily punched out. The legs 124 and 126 are completely open at 125 and 127, joined by webs 128. The opening 129 can be closed by sealing the webs 128 by heat or an adhesive. After sealing, the webs can be removed with a die cutter, leaving a small flashing at 146 and 148 to seal and maintain the integrity of the tubular legs 124 and 126.

Thus there has been disclosed a unique water ski tow line handle tied in a unique way to substantially eliminate rotation of the hand grip to prevent roll-out. The handle is covered with unique end caps having a cup that tightly fits around each end of the handle to protect the line and handle and cover the loop formed by the method of tying the lines. In an alternate embodiment of the invention, the hand grip and sleeves for covering the line are formed in one molded piece. Additionally, the yoke of the line is protected by a unique yoke cover formed with a tool that allows the yoke cover to be quickly and easily formed with a joining web which may or may not be removed.

This invention is not to be limited by the embodiment shown in the drawings and described in the description which is given by way of example and not of limitation, but only in accordance with the scope of the appended claims.

What is claimed is:

1. A water ski tow line comprising, a handle having holes through each end, said holes being oriented horizontally parallel to a plane through the axis of said handle and the extended tow line;

a hollow braid tow line tied to each end of said handle by being threaded through each of said holes to form a connection at each end of the handle of two lines extending away from tangent points on opposite sides of said handle;

said tow line being tied to the handle by being looped around the back of the handle, the respective ends of the line being threaded parallel to each other through the holes and back through itself and extending from tangent points on opposite side of the handle;

said two lines being joined at a splice a predetermined distance from said handle;

whereby said two lines provide anti-roll torque on opposite sides of said handle to prevent rotation.

2. The water ski tow line according to claim 1 including end caps have cups covering the ends of the handles and sleeves receiving and covering said two lines.

3. The water ski tow line according to claim 2 in which said sleeves are formed with channels for receiving and separating said two lines and a web formed between said two channels covering a loop formed by said two lines.

4. The water ski tow line according to claim 3 in which said sleeves extend over and cover the splice of said two lines.

5. The water ski tow line according to claim 1 in which said two lines extend away from each end of said handle and are joined to create a single line forming a yoke; and including a Y-shaped resilient protective piece covering said yoke.

6. The water ski tow line according to claim 5 in which said Y-shaped protective piece has a web between the legs of said Y-shaped providing strength and a decorative surface.

7. The water ski tow line according to claim 2 in which said cups have a recess for receiving the line wrapped around said handle extending to and terminating in a flanged lip to tightly grip the surface of the handle.

8. The water ski tow line according to claim 2 in which said handle and end caps are a molded one piece construction.

9. The water ski tow line according to claim 7 in which said handle is comprised of a tube having a hole in each end covering with a thick coating of resilient material forming a gripping surface on said handle and integrally formed end caps.

* * * * *